United States Patent [19]

Kaneda et al.

[11] Patent Number: 4,664,609

[45] Date of Patent: May 12, 1987

[54] VANE HOLDER FOR VANE PUMP AND METHOD OF MAKING SAME

[75] Inventors: Hiroshi Kaneda, Saitama; Masahito Mitsumori, Tokyo; Kenji Hamabe, Saitama, all of Japan

[73] Assignee: Honda Giken Kogyo Kabushiki Kaisha, Tokyo, Japan

[21] Appl. No.: 823,967

[22] Filed: Jan. 29, 1986

Related U.S. Application Data

[63] Continuation of Ser. No. 681,556, Dec. 14, 1984, abandoned.

[30] Foreign Application Priority Data

Dec. 14, 1983 [JP] Japan ..... 58-235292
Mar. 16, 1984 [JP] Japan ..... 59-50465

[51] Int. Cl.[4] ..... F04C 18/344; F04C 29/00; B22D 19/04

[52] U.S. Cl. ..... 418/137; 418/151; 164/98; 164/108; 164/111

[58] Field of Search ..... 418/136–138, 418/151, 241; 164/98, 99, 108, 111

[56] References Cited

U.S. PATENT DOCUMENTS

| | | | |
|---|---|---|---|
| 974,481 | 11/1910 | Gibson et al. | 418/151 |
| 1,396,341 | 11/1921 | Rautenbach | 164/111 |
| 1,716,833 | 6/1929 | Rich | 164/99 |
| 1,923,075 | 8/1933 | Brown | 164/98 |
| 2,332,330 | 10/1943 | McMahan | 164/98 |
| 3,401,026 | 9/1968 | Walker et al. | 164/98 |
| 3,713,426 | 1/1973 | Jensen | 418/241 |
| 3,790,317 | 2/1974 | Hyde et al. | 164/111 |
| 4,100,669 | 7/1978 | Pemper | 164/111 |

FOREIGN PATENT DOCUMENTS

| | | | |
|---|---|---|---|
| Ad.35682 | 10/1929 | France | 418/151 |

*Primary Examiner*—John J. Vrablik
*Attorney, Agent, or Firm*—Lyon & Lyon

[57] ABSTRACT

A vane air pump has a vane holder which includes a main body. A vane extends outward from one side of the main body and a balance weight extends outward from the other side of the main body in a direction opposite to the vane. The balance weight is cast integrally with the main body. The method discloses integrally forming a balance weight with the main body of the vane holder.

8 Claims, 10 Drawing Figures

VANE HOLDER FOR VANE PUMP AND METHOD OF MAKING SAME

This application is a continuation, of application Ser. No. 681,556, filed Dec. 14, 1984, now abandoned.

The balance weights for a vane holder in a vane pump provide balance during rotation of the vane holder to increase the life expectancy of the vane holder bearings. These balance weights have conventionally been bolted to the main body of the vane holder. Bolting the balance weights to the main body provides difficulty in obtaining the desired weight since the weight of bolts must be taken into consideration. In addition bolting requires costly machining in forming a bolt hole in the balance weight and a mating threaded hole on the main body of the vane holder.

A vane holder for a vane pump includes a main body which is formed for rotation on a vane shaft. A vane extends outward from one side of the main body and a balance weight extends outward from the other side of the main body in a direction opposite to the vane. The balance weight of this invention is cast integrally with the main body. In one form where a thick walled balance weight is cast integrally with the main body a metal insert is provided in the thick walled balance weight.

The novel vane holders of the invention provides balance weights which are accurate in weight. Since these balance weights are integral to the main body there is no danger they will be thrown off and damage the air pump. In addition, expensive machining for a mechanical fastener is eliminated. And lastly, the novel vane holder may be made smaller in size since the invention eliminates the need to provide a thick walled main body for attachment of the balance weight.

The novel method of integrally casting the balance weight also provides economy of manufacture as well as the structural advantages of the novel vane holder previously described.

Figure 1:
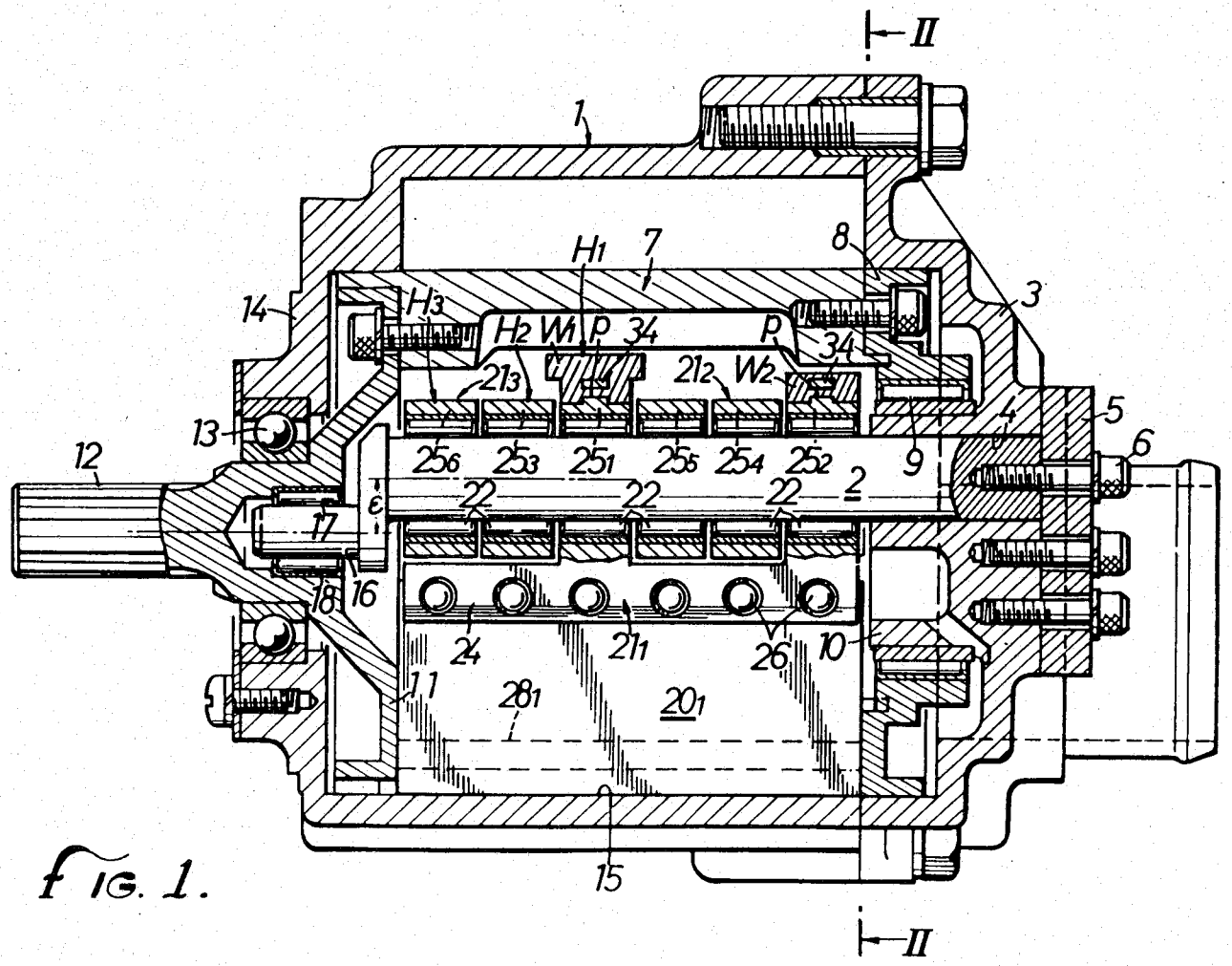
FIG. 1 is a sectional view for the vane air pump of the invention.
Figure 2:
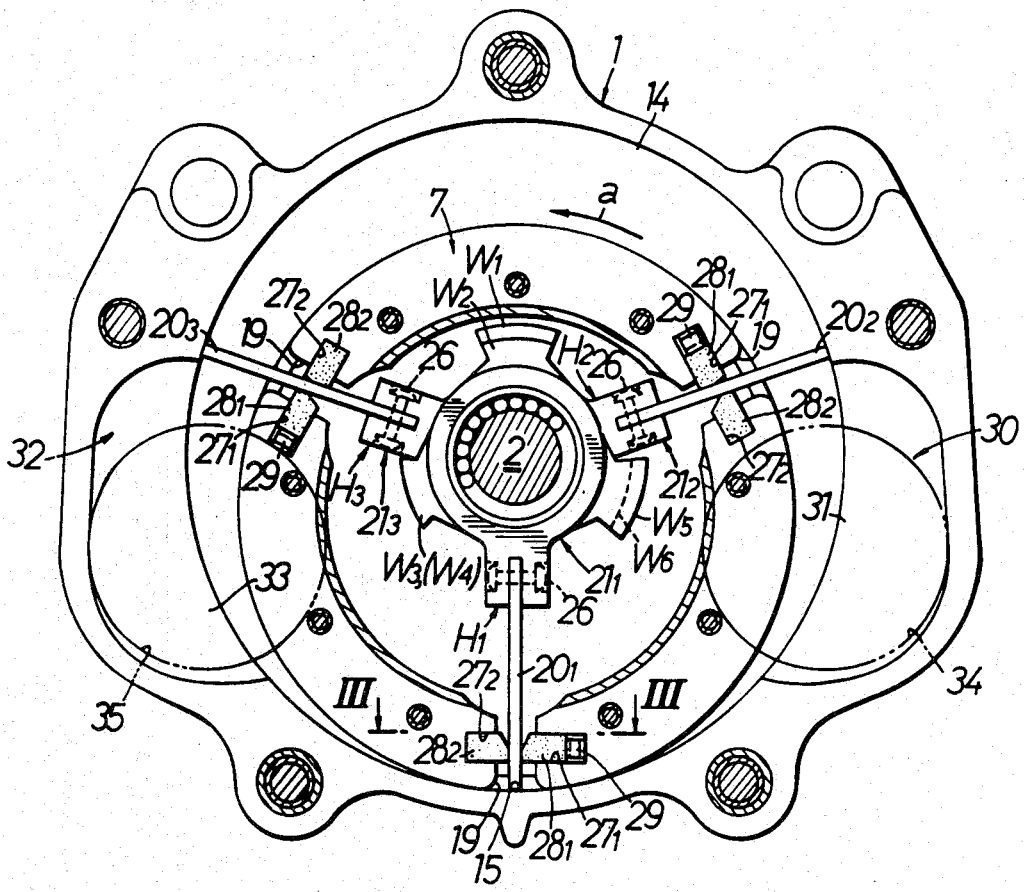
FIG. 2 is a sectional view taken on section line II—II of FIG. 1.

Turning in detail to the drawings, FIGS. 1 through 5 show a vane air pump. In FIGS. 1 and 2 a vane shaft 2 is positioned in a cylindrical casing 1 with its axis line coinciding with the center line thereof. One end of the vane shaft 2 is inserted into a through bore 4 formed on one end wall 3 of the casing 1. The vane shaft 2 is mounted fixed to the casing 1 with the axial bolt 6.

A cylindrical rotor 7 surrounding the vane shaft 2 is positioned in the casing 1. One ring end wall 8 is rotatably supported by a boss portion 10 of the end wall 3 on a bearing 9. A drive shaft portion 12 which is provided on the other end wall 11 of the rotor 7 is rotatably supported by the other ring wall 14 of the casing 1 on a bearing 13. The drive shaft portion 12 is connected to an engine through a transmitting means (not shown) such as to rotate the rotor 7 in the direction indicated by the arrow "a" in FIG. 2.

The center of rotation of the rotor 7 is eccentric as shown in FIG. 1 in relation to the center line of the casing 1. This causes a part of the outer peripheral surface of the rotor 7 to always be slidably in contact with a land portion 15 of the inner peripheral surface of the casing 1. The other end of the vane shaft 2 is formed in a shape of crank 16. The crank end 16 of the shaft is removably supported on a bearing 17 positioned in a bearing bore 18 formed on the drive shaft portion 12 of the rotor 7.

Three slots 19 are formed in parallel with the center line of rotation at regular intervals on the peripheral wall of the rotor 7. The first to third vanes $20_1$–$20_3$ are positioned through the slots 19 with the base ends secured to the first to third vane holders $H_1$ through $H_3$. The first to third vane holders $H_1$ through $H_3$ are rotatably supported by the vane shaft 2 on needle bearings 22.

Figure 4:
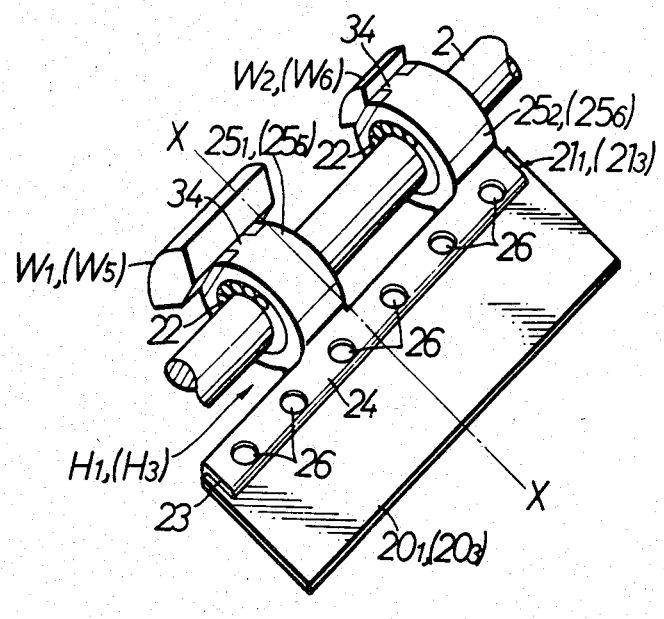
FIG. 4 is a perspective view of the first and the third vanes of the vane air pump of FIG. 1.

The first to third vane holders $H_1$ through $H_3$ include main bodies $21_1$ through $21_3$ and first to sixth balance weights $W_1$ through $W_6$. The main bodies $21_1$ and $21_3$ of the first and the third vane holders have the same configuration as is shown in FIG. 4 and include (1) bar vane adapter portions 24 having channels 23 and (2) pairs of cylindrical bearing holder portions $25_1$, $25_2$, $25_5$ and $25_6$. The base end of the first and the third vanes $20_1$ and $20_3$ are inserted into the channels 23 of the main bodies $21_1$ and $21_3$ and attached by a plurality of rivets 26.

The main body $21_2$ of the second vane holder has a bar vane adapter portion 24 similar to those of the main bodies $21_1$ and $21_3$, and a pair of cylindrical bearing holder portions $25_3$ and $25_4$ which are positioned equidistant from both ends.

The needle bearing 22 is inserted into each of the bearing holder portions $25_1$ through $25_6$ of the main bodies $21_1$ through $21_3$ of the first to second vane holders.

The main bodies $21_1$ and $21_3$ of the first and the third vane holders are supported symmetrically on the vane shaft 2. The bearing holder portion $25_5$ on the middle part of the main body $21_3$ of the third vane holder is placed between both the bearing holder portions $25_1$ and $25_2$ of the main body $21_1$ of the first vane holder such as to be adjacent to the bearing holder portion $25_1$ in the middle portion of the main body $21_1$ of the first vane holder. The bearing holder $25_6$ on the end portion of the main body $21_3$ of the third vane holder is placed on the end adjacent the end wall 11, while the bearing holder portion $25_3$ of the main body $21_2$ of the second vane holder is placed between the bearing holder portion $25_1$ on the middle portion of the main body $21_1$ of the first vane holder and the bearing holder portion $25_6$ on the end portion of the main body $21_3$ of the third vane holder. The bearing holder portion $25_4$ is placed between the bearing holder portion $25_2$ on the end of the main body $21_1$ of the first vane holder and the bearing holder portion $25_5$ on the middle portion of the main body $21_3$ of the third vane holder.

The first to sixth balance weights $W_1$ through $W_6$ are secured to each bearing holder portion $25_1$ through $25_6$ such as to project in a direction opposite to each of the first to third vanes $20_1$ through $20_3$ to provide rotational balance of each of the vanes $20_1$ through $20_3$. The method of securing these balance weights will be described later.

The end of each of the vanes $20_1$ through $20_3$ (which is immersed into the rotor 7 in the land portion 15) contacts the inner peripheral surface of the casing 1 and with the rotation of the rotor 7 slides on the inner peripheral surface of the casing 1 in a circumferential direction.

Figure 3:
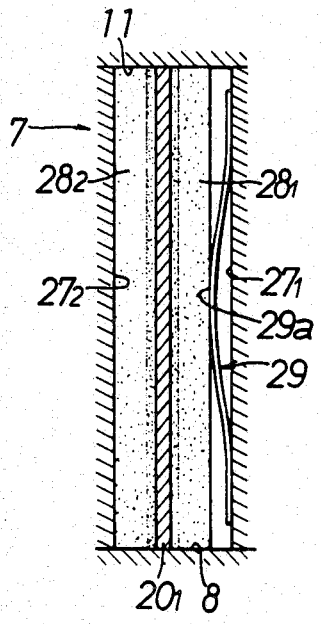
FIG. 3 is a sectional view taken on section line III—III of FIG. 2.

Channels $27_1$ and $27_2$ are formed in the longitudinal direction of the slot 19 on both sides of the slots 19 with the opening portions opposed to each other. Sealing members $28_1$ and $28_2$ made of carbon are fitted into the front and rear channels $27_1$ and $27_2$. As shown in FIG. 3 a V-shaped leaf spring 29 which has an apex 29*a* in the central part of a longitudinal direction is positioned in the front channels $27_1$ between the bottom part of the channel $27_1$ and the sealing member $28_1$. The leaf spring 29 forces both the sealing members $28_1$ and $28_2$ into contact with both side surfaces of each of the vanes $20_1$ through $20_3$.

The inner peripheral surface of the casing 1 includes an opening 31 to an intake chamber 30 and an opening 33 to a discharge chamber 32. The land portion 15 is positioned between the openings 31 and 33. The intake chamber 30 has an inlet 34 which connects to an intake port and the discharge chamber 32 has an outlet 35 which connects to a discharge port.

Figure 6:
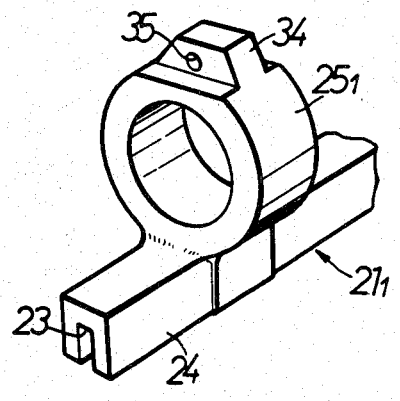
FIG. 6 is a perspective view of a portion of the main body of the first vane holder for the vane air pump of FIG. 1.

The first to sixth balance weights $W_1$ through $W_6$ are attached to the main bodies $21_1$ through $21_3$ of the first to the third vane holders as follows. As shown in FIG. 6, the bearing holder portion $25_1$ of the main body $21_1$ of the first vane holder is made of a light alloy with a relatively low melting point such as aluminum alloy and has a balance weight securing portion 34 on the outer peripheral surface on the side opposite the vane adapter portion 24. The weight securing portion 34 contains an anchor hole 35 parallel to the vane shaft 2.

Figure 7:
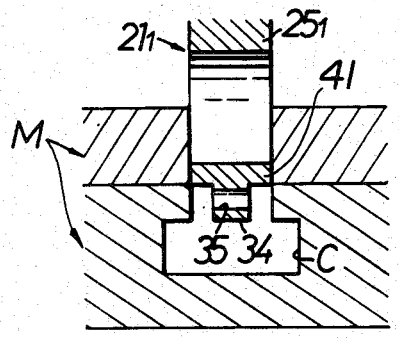
FIG. 7 is a sectional view of the main body of the vane holder positioned in a mold for casting a balance weight.
Figure 8:
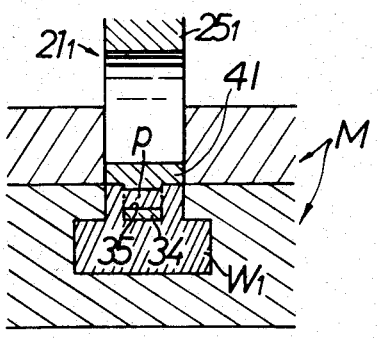
FIG. 8 is the sectional view shown in FIG. 7 illustrating the cast balance weight.

In the preferred method of securing the balance weight as shown in FIG. 7, the bearing holder portion $25_1$ is first positioned in a die or mold M to cast the balance weight. The weight securing portion 34 fits within a cavity C of the mold M. Then, as shown in FIG. 8, molten metal of copper alloy, the specific gravity of which is larger than aluminum alloy and the melting point of which is higher than aluminum alloy, is charged into the cavity C to cast the first balance weight $W_1$. The molten metal fills the cavity C including the anchor hole to form the anchor pin portion P. The anchor pin portion P integrally attaches the first balance weight $W_1$ to the main body $21_1$ of the first vane holder. The second balance weight $W_2$ is cast as described for $W_1$. The weight of the first balance weight $W_1$ (on the side nearer to the bisector line X—X) of the first vane $20_1$ is set to be heavier than that of the second balance weight $W_2$ (on the side farther from the bisector line X—X).

A similar weight distribution is provided in the main body $21_3$ of the third vane holder which support third vane $20_3$. As shown in FIG. 4 the fifth and sixth balance weights $W_5$ and $W_6$ are also attached to both the bearing holder portions $25_5$ and $25_6$ by casting in a cavity C.

Figure 5:
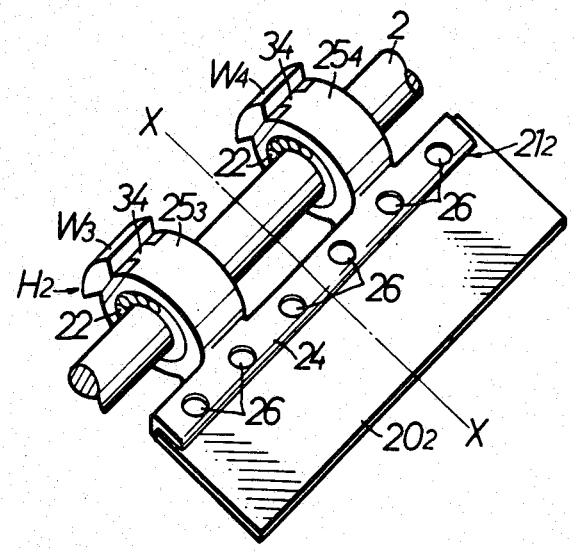
FIG. 5 is a perspective view of the second vane of the vane air pump of FIG. 1.

In the main body $21_2$ of the second vane holder which supports the second vane $20_2$ both the bearing holder portions $25_3$ and $25_4$ are equidistant from the bisector line X—X. Therefore the third and the fourth balance weights $W_3$ and $W_4$ are of equal weight and are also attached to both the bearing holder portions $25_3$ and $25_4$ as shown in FIG. 5 by casting in a cavity C.

During operation of the air pump, the rotor 7 rotates in the direction indicated by the arrow "a" in FIG. 2. As the rotor 7 rotates each of the vanes $20_1$ through $20_3$ slide on the inner peripheral surface of the casing 1. Since the rotor 7 is eccentrically mounted in the casing 1 to slidably contact the land portion 15, the length of protrusion from the outer peripheral surface of the rotor 7 first gradually increases for the first 180 degrees of rotation and then gradually decreases for the next 180 degrees of rotation. This causes each of the vanes $20_1$ through $20_3$ to pump air by intaking and carrying air from the intake chamber 30 to the discharge chamber 32.

The rotational balance of the first and the third vanes $20_1$ and $20_3$ is provided by positioning the heavy first and fifth balance weights $W_1$ and $W_5$ on the needle bearing 22 side of the bearing holder portions $25_1$ and $25_5$ on which a heavy radial load exists and by positioning the second and the sixth balance weights $W_2$ and $W_6$ which are lighter than the first and the fifth balance weights $W_1$ and $W_5$ on the needle bearing 22 side of the other bearing holder portions $25_2$ and $25_6$ on which a lighter radial load exists. This results in increased durability of each needle bearing 22 and minimum wear on the first and the third vanes $20_1$ and $20_3$. The rotational balance of the second vane $20_2$ is provided by using the same weight for the third and the fourth balance weights $W_3$ and $W_4$.

Each of the balance weights $W_1$ through $W_6$ are retained firmly on each of the bearing holder portions $25_1$ through $25_6$ by each integrally cast anchor pin P. This prevents the balance weights from slipping off the bearing holders during the rotation of each of the vanes $20_1$ through $20_3$.

Figure 9:
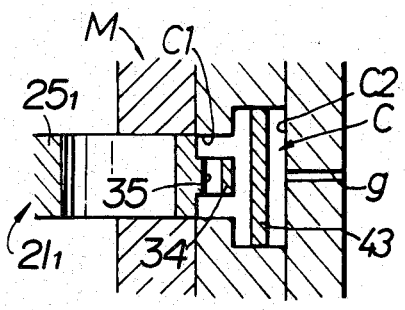
FIG. 9 is a sectional view similar to FIG. 7 of the main body of an alternative vane holder positioned in a mold having a metal insert for casting a balance weight.
Figure 10:
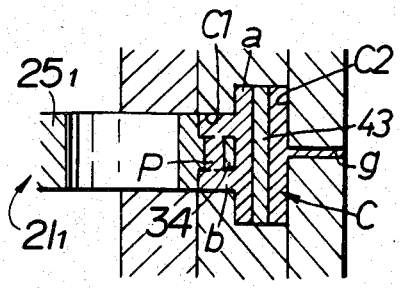
FIG. 10 is the sectional view shown in FIG. 9 illustrating the cast balance weight.

An alternative method of casting the thick-walled balance weights $W_1$, $W_3$, $W_4$ and $W_5$ is shown in FIGS. 9 and 10. The bearing holder portion, as shown in FIG. 9, is positioned in a mold or die M to cast the balance weight. The weight securing portion 34 fits within the cavity C of the mold M. The cavity C is formed of a cavity portion $C_1$ in which the adapter A of the first balance weight $W_1$ is formed and a cavity portion $C_2$ in which the main body B of the first balance weight $W_1$ is formed. In about the mass center of the cavity portion $C_2$ (where the main body B of the first balance weight $W_1$ is formed) there is positioned a rod-like metal insert 43 made of copper alloy such as brass. The metal insert 43 is positioned in the cavity portion $C_2$ substantially parallel with the anchor hole 35.

Then, as shown in FIG. 10, molten metal of copper alloy (the specific gravity of which is larger than aluminum alloy) is charged under pressure into the cavity C such as through the mold gate G to cast the first balance weight $W_1$. The molten metal fills the cavity C including the anchor hole 35 to form the anchor pin portion P. The anchor pin portion integrally attaches the first balance weight $W_1$ to the main body $21_1$ of the first vane holder. As the molten metal fills the cavity portion $C_2$ of the cavity C it surrounds the insert metal 43. This molten metal surrounding the insert metal 43 is rapidly cooled to solidification by the insert metal 43 to prevent a possible cavity in the thick walled main body B of the first balance weight $W_1$.

The material of the insert metal 43 is not limited to copper alloy but may be an iron alloy which has a specific gravity approximate to that of copper alloy.

The thick walled third to fifth balance weights $W_3$ through $W_5$ may also be cast by the alternative casting method similar to that of the first balance weight $W_1$. The second and the sixth balance weights $W_2$ and $W_6$ are thin walled and therefore may easily be cast by the preferred casting method as previously described. The weight securing portions 34 of the bearing holder portion is located within the entire adapter portion A and partially in the main body B of these balance weights. The weight securing portion 34 acts to cool the molten metal therefore no insert metal is necessary in that area similar to insert 43 in the large body portions B of balance weights $W_1$ and $W_5$.

What is claimed is:

1. A vane holder for a vane pump comprises a main body which is formed for rotation on a vane shaft; a vane extending outward from one end of said main body; a balance weight extending outward from the other end of said main body only in a direction opposite to said vane, said balance weight being cast integrally with said main body, said main body being made of a light metal alloy and said balance weight being made of a metal having a specific gravity which is larger than the specific gravity of said light metal alloy, and the light metal alloy of said main body having a melting temperature lower than that of the metal of the balance weight cast onto the main body.

2. A vane pump for compressing air from an air inlet to an air outlet comprising a pump casing having an interior cylindrical surface, a hollow cylindrical rotor having a radial slot positioned for eccentric rotation in said casing, within said cylindrical rotor, a vane shaft axially fixed to said pump casing, within said cylindrical rotor, a vane holder rotatably positioned on said vane shaft, said vane holder including a main body rotatably mounted on said vane shaft, a vane fixed at one side of said main body and extending through said radial slot in said cylindrical rotor for sliding engagement with said interior cylindrical surface of said pump casing, and a balance weight extending outwardly from the other side of said main body and only in a direction opposite to said vane, said main body including a means for casting said balance weight intergrally to said main body, said main body being made of a light metal alloy and said balance weight being made of a metal having a specific gravity which is greater than the specific gravity of said light metal alloy, and the light metal alloy of the main body having a melting temperature lower than that of the metal of the balance weight cast onto the main body.

3. The vane pump defined in claim 2 wherein said means for casting said balance weight integrally to said main body is a cast portion of said balance weight conforming to a securing portion of said main body.

4. The vane pump defined in claim 3 wherein said securing portion of said main body is a hole and said cast portion of said balance weight conforms to said hole.

5. A method of manufacturing a vane holder for a vane pump having a vane extending from one side of a main body comprising the steps of:

securing a thick-walled balance weight to the other side of said main body to extend only in a direction opposite to the vane by die-casting said balance weight integrally to said main body from a casting metal having both a higher melting temperature and a higher specific gravity than the metal of the main body.

6. A method of manufacture of a vane holder for a vane pump having a vane extending from one side of the main rotatable body and a balance weight extending from the opposite side of the main rotating body only in the direction opposite to the vane comprising the steps of positioning the balance weight side of said main body into a metal cast mold having a cavity of the shape of said balance weight; and casting said balance weight from a casting metal having both a higher melting temperature and a higher specific gravity than the metal of the main body and directly against said main body in said cast mold to integrally fix mating surfaces of said main body and balance weight together.

7. The method according to claim 6 further including the step of, positioning a metal insert in said mold cavity prior to casting said balance weight for assisting in rapidly cooling the casting metal.

8. A method of manufacturing of a vane holder for a vane pump having a vane extending from one side of the vane holder body and a balance weight extending from tne opposite side of the vane holder body only in a direction away from the vane, the vane holder body having an anchor means and said balance weight conforming with the anchor means to retain said balance weight on said body comprising the steps of positioning the balance weight side of the vane holder body in a casting mold, positioning a metal insert in the casting mold at about the mass center of said balance weight, filling said mold with a liquid melted metal having a melting temperature greater than the melting temperature of the metal of the vane holder body and surrounding said metal insert with said liquid melted metal, and cooling said liquid melted metal surrounding said metal insert at least in part by means of the contact with and heat conduction to said metal insert to form said balance weight.

* * * * *